US011495200B2

(12) United States Patent
Feng et al.

(10) Patent No.: US 11,495,200 B2
(45) Date of Patent: Nov. 8, 2022

(54) REAL-TIME SPEECH TO SINGING CONVERSION

(71) Applicant: Agora Lab, Inc., Santa Clara, CA (US)

(72) Inventors: Jianyuan Feng, Shanghai (CN); Ruixiang Hang, Shanghai (CN); Linsheng Zhao, Shanghai (CN); Fan Li, Shanghai (CN)

(73) Assignee: Agora Lab, Inc., Santa Clara, CA (US)

( * ) Notice: Subject to any disclaimer, the term of this patent is extended or adjusted under 35 U.S.C. 154(b) by 0 days.

(21) Appl. No.: 17/149,224

(22) Filed: Jan. 14, 2021

(65) Prior Publication Data

US 2022/0223127 A1 Jul. 14, 2022

(51) Int. Cl.

| | |
|---|---|
| ***G10H 1/36*** | (2006.01) |
| ***G10L 21/013*** | (2013.01) |
| ***G10L 21/055*** | (2013.01) |
| ***G10L 25/15*** | (2013.01) |
| ***G10L 25/90*** | (2013.01) |
| ***G10L 25/24*** | (2013.01) |
| ***G10L 13/033*** | (2013.01) |
| *G10H 1/38* | (2006.01) |

(52) U.S. Cl.

CPC ..... *G10H 1/366* (2013.01); *G10L 13/0335* (2013.01); *G10L 21/013* (2013.01); *G10L 21/055* (2013.01); *G10L 25/15* (2013.01); *G10L 25/24* (2013.01); *G10L 25/90* (2013.01); *G10H 1/38* (2013.01)

(58) Field of Classification Search

None

See application file for complete search history.

(56) References Cited

U.S. PATENT DOCUMENTS

| | | | | |
|---|---|---|---|---|
| 3,649,765 | A * | 3/1972 | Rabiner | G10L 19/02 704/209 |
| 6,304,846 | B1 * | 10/2001 | George | G10L 13/033 704/205 |
| 7,016,841 | B2 * | 3/2006 | Kenmochi | G10L 13/07 704/266 |
| 7,183,482 | B2 * | 2/2007 | Kobayashi | G10H 1/0066 84/645 |
| 8,729,374 | B2 * | 5/2014 | Haupt | G10L 21/013 84/610 |
| 9,324,330 | B2 * | 4/2016 | Chordia | G10H 1/366 |
| 9,459,768 | B2 * | 10/2016 | Chordia | G10L 21/003 |
| 10,008,193 | B1 * | 6/2018 | Harvilla | G10H 1/20 |
| 10,818,308 | B1 * | 10/2020 | Chu | G10L 13/00 |
| 10,971,125 | B2 * | 4/2021 | Yang | G10H 7/02 |

(Continued)

OTHER PUBLICATIONS

Masanori Morise; D4C, a band-aperiodicity estimator for high-quality speech synthesis; Speech Communication 84 (2016) pp. 57-65; journal homepage: www elsevier.com/locate/specom.

*Primary Examiner* — Shaun Roberts

(74) *Attorney, Agent, or Firm* — Young Basile Hanlon & MacFarlane, P.C.

(57) ABSTRACT

A method of converting a frame of a voice sample to a singing frame includes obtaining a pitch value of the frame; obtaining formant information of the frame using the pitch value; obtaining aperiodicity information of the frame using the pitch value; obtaining a tonic pitch and chord pitches; using the formant information, the aperiodicity information, the tonic pitch, and the chord pitches to obtain the singing frame; and outputting or saving the singing frame.

18 Claims, 10 Drawing Sheets

(56) References Cited

U.S. PATENT DOCUMENTS

2008/0314231 A1* 12/2008 Vorobyev ..... G10H 1/0008
84/609
2009/0076822 A1* 3/2009 Sanjaume ..... G06F 3/16
704/E13.004
2009/0182556 A1* 7/2009 Reckase ..... G10L 25/93
704/208
2013/0066631 A1* 3/2013 Wu ..... G10L 13/08
704/258
2013/0151256 A1* 6/2013 Nakano ..... G10L 13/0335
704/268
2015/0025892 A1* 1/2015 Lee ..... G10L 21/007
704/267
2015/0310850 A1* 10/2015 Nakano ..... G10H 1/0066
704/258
2021/0256958 A1* 8/2021 Yu ..... G10H 1/00

* cited by examiner

REAL-TIME SPEECH TO SINGING CONVERSION

CROSS REFERENCES TO RELATED APPLICATIONS

None.

TECHNICAL FIELD

This disclosure relates generally to speech enhancement and more specifically to converting a speech to a singing voice in, for example, real-time applications.

BACKGROUND

Many interactions occur online over different communication channels and via many media types. An example of such interactions is real-time communication (RTC) using video conferencing or streaming or a simple telephone voice calls (e.g., Voice over Internet Protocol). The video can include audio (e.g., speech, voice) and visual content. One user (i.e., a sending user) may transmit (e.g., the video) to one or more receiving users. For example, a concert may be live-streamed to many viewers. For example, a teacher may live-stream a classroom session to students. For example, a few users may hold a live chat session that may include live video.

In real-time communications, some users may wish to add filters, masks, and other visual effects to add an element of fun to the communications. To illustrate, a user can select a sunglasses filter, which the communications application digitally adds to the user's face. Similarly, users may wish to modify their voice. More specifically, a user may wish to modify his/her voice to be a singing voice according to some reference sample.

SUMMARY

A first aspect of the disclosed implementations is a method of converting a frame of a voice sample to a singing frame. The method includes obtaining a pitch value of the frame; obtaining formant information of the frame using the pitch value; obtaining aperiodicity information of the frame using the pitch value; obtaining a tonic pitch and chord pitches; using the formant information, the aperiodicity information, the tonic pitch, and the chord pitches to obtain the singing frame; and outputting or saving the singing frame.

A second aspect of the disclosed implementations is an apparatus for converting a frame of a voice sample to a singing frame. The apparatus includes a processor that is configured to obtain a pitch value of the frame; obtain formant information of the frame using the pitch value; obtain aperiodicity information of the frame using the pitch value; obtain a tonic pitch and a chord pitch; use the formant information, the aperiodicity information, the tonic pitch and the chord pitch to obtain the singing frame; and output or save the singing frame.

A third aspect of the disclosed implementations is a non-transitory computer-readable storage medium that includes executable instructions that, when executed by a processor, facilitate performance of operations including obtaining a pitch value of the frame; obtaining formant information of the frame using the pitch value; obtaining aperiodicity information of the frame using the pitch value; obtaining a tonic pitch and chord pitches; using the formant information, the aperiodicity information, the tonic pitch, and the chord pitches to obtain the singing frame; and outputting or saving the singing frame.

It will be appreciated that aspects can be implemented in any convenient form. For example, aspects may be implemented by appropriate computer programs which may be carried on appropriate carrier media which may be tangible carrier media (e.g. disks) or intangible carrier media (e.g. communications signals). Aspects may also be implemented using suitable apparatus which may take the form of programmable computers running computer programs arranged to implement the methods and/or techniques disclosed herein. Aspects can be combined such that features described in the context of one aspect may be implemented in another aspect.

BRIEF DESCRIPTION OF THE DRAWINGS

The description herein makes reference to the accompanying drawings wherein like reference numerals refer to like parts throughout the several views.

DETAILED DESCRIPTION

Figure 1:
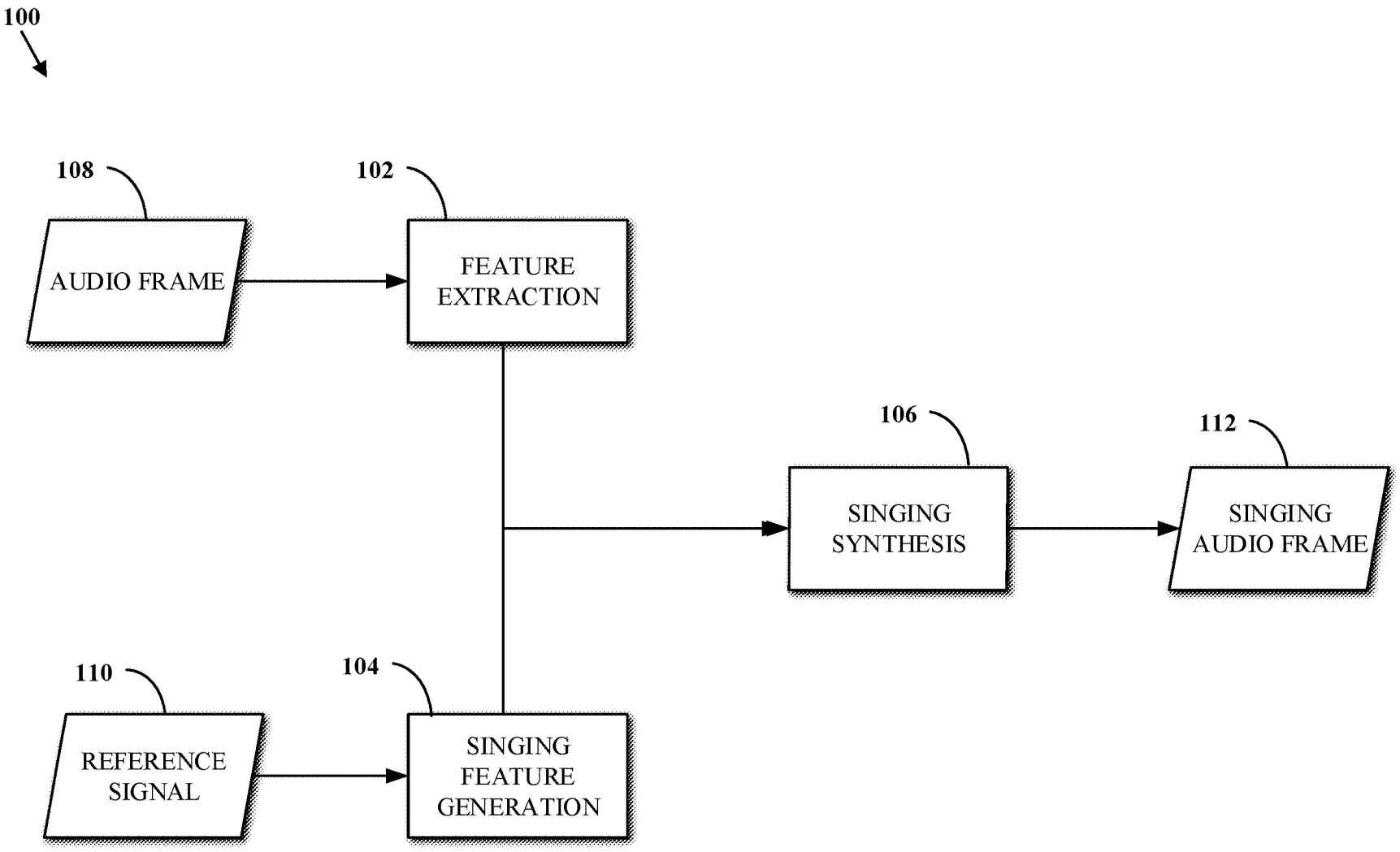
FIG. 1 is an example, of a system for speech to singing conversion according to implementations of this disclosure.

As mentioned above, a user may wish to have his/her voice (i.e., speech) converted to a singing voice according to a reference sample. That is, while the user is speaking in his/her regular voice (i.e., a source voice sample), a remote recipient of the user's voice may hear the user's speech being sung according to the reference sample. That is, the pitch of the speaker is modified (e.g., tuned, etc.) to follow the melody of the reference sample, which may be a song, a tune, a musical composition, or the like.

While traditional pitch tuning techniques, such as phase vocoder or Pitch Synchronous Overlap and Add (PSOLA), can modify the pitch of a speech, such techniques may also change the voice formant as the energy distribution of the whole frequency band may be expanded or squeezed evenly. As a result, the output (e.g., result) of such techniques is speech (e.g., voice) that does not resemble that of the speaker, may sound like that of another person, or become unnatural (e.g., robotic, etc.). That is, the traditional techniques tend to lose the identity of the original speaker.

When converting a voice sample to a singing voice according to a reference, preservation of the identity of the speaker is desirable. The identity of the speaker (e.g., the uniqueness of the speaker's voice) can be embedded (e.g., encoded, etc.) in the formant information. A formant is a concentration of acoustic energy around a particular frequency in a speech wave. A formant denotes resonance characteristics of the vocal tract when a vowel is uttered. Each cavity within the vocal tract can resonate at a corresponding frequency. These resonance characteristics can be used to identify the voice quality of an individual.

With respect to the reference sample, the tonic pitch trajectory and the chords of the reference sample are to be applied to the voice sample. Tonic pitch refers to the beginning and ending note of the scale used to compose a piece of music. A tonic note can be defined as the first scale degree of a diatonic scale, a tonal center, and/or a final resolution tone. For example, referring to a reference sample (e.g., a musical composition) as being "in the key of" C major implies that the reference sample is harmonically centered on the note C and making use of a major scale whose first note, or tonic, is C. The main pitch in the reference sample can be defined as the tone which occurs with the greatest amplitude. The tonic pitch trajectory refers to the sequence of tonic pitches in the reference sample. A chord is defined as a sequence of notes separated by intervals. A chord can be a set of notes that are played together.

The traditional technique for singing voice generation may generate multiple tracks for chords based on the tonic track and mix the chords tracks with the tonic track to generate the singing signal. Such techniques result in increased computational cost, a downside of which is the impracticality of implementation on portable devices, such as a mobile phone.

Implementations according to this disclosure can be used to convert a voice sample (e.g. speech sample) to a singing voice based on a reference sample. The speech-to-singing techniques described herein can modify the pitch trajectory of an original voice according to the pitch reference of a given melody without changing the identity of the speaker. The conversion can be performed in real time. The conversion can be performed according to a static reference sample or a dynamic reference sample. In the case of the static reference sample, preset trajectories for tonic and chords pitches can be looped over time. In the case of a dynamic reference sample (i.e., dynamic mode), tonic and chords pitch signals can be received (e.g., calculated, extracted, analyzed, etc.) in real time from an input device (or virtual device) such as a keyboard or touch screen. For example, a musical instrument may be playing in the background as the user is speaking and the voice of the user can be modified according to the tonic and chords of the played music.

FIG. 1 is an example, of an apparatus 100 for speech to singing conversion according to implementations of this disclosure. The apparatus 100 can convert a received audio sample to a singing voice. The apparatus 100 may be, may be implemented in, or may be a part of a sending device of a sending user. The apparatus 100 may be, may be implemented in, or may be a part of a receiving device of a receiving user.

The apparatus 100 can receive the audio sample (e.g., speech) of a sending user. For example, the audio sample may be spoken by the sending user, such as during an audio or a video teleconference with one or more receiving users. In an example, the sending device of the sending user can convert the voice of the sending user to a singing voice and then transmit the singing voice to the receiving user. In another example, the voice of the sending user can be transmitted as is to the receiving user and the receiving device of the receiving user can convert the received voice to a singing voice prior to outputting the singing voice to the receiving user, such as using a microphone of the receiving device. The singing voice output can be output to a storage medium, such as to be played later.

The apparatus 100 receives the source voice in frames, such as a source audio frame 108. In another example, the apparatus 100 itself can partition a received audio signal into the frames, including the source audio frame 108. The apparatus 100 processes the source voice frame by frame. A frame can correspond to an m number of milliseconds of audio. In an example, m can be 20 milliseconds. However, other values of m are possible. The apparatus 100 outputs (e.g., generates, obtains, results in, calculates, etc.) a singing audio frame 112. The source audio frame 108 is the original speech of the sending user and the singing audio frame 112 is the singing audio frame according to a reference signal 110.

The apparatus 100 includes a feature extraction module 102, a singing feature generation module 104, and a singing synthesis module 106. The feature extraction module 102 can estimate the pitch and formant information of each received audio frame (i.e., the source audio frame 108). As used in this disclosure, "estimate" can mean calculate, obtain, identify, select, construct, derive, form, produce, or other estimate in any manner whatsoever. The singing feature generation module 104 can provide the tonic pitch and the chords pitches, from the reference signal 110 to be applied to each frame (i.e., the source audio frame 108). The singing synthesis module 106 uses the information provided by the feature extraction module 102 and the singing feature generation module 104 to generate the singing signals (i.e., the singing audio frame 112) frame by frame.

To summarize, and by way of illustration, when a speaker is speaking, the features of the real-time speech signal are extracted by the feature extraction module 102; meanwhile singing information such as tonic and chords pitches are generated by the singing feature generation module 104; and the singing synthesis module 106 generates the singing signals based on both speech and singing features.

The feature extraction module 102, the singing feature generation module 104, and the singing synthesis module 106 are further described below with respect to FIGS. 2A-2D, 3A-3D, and 4 respectively.

Figure 6:
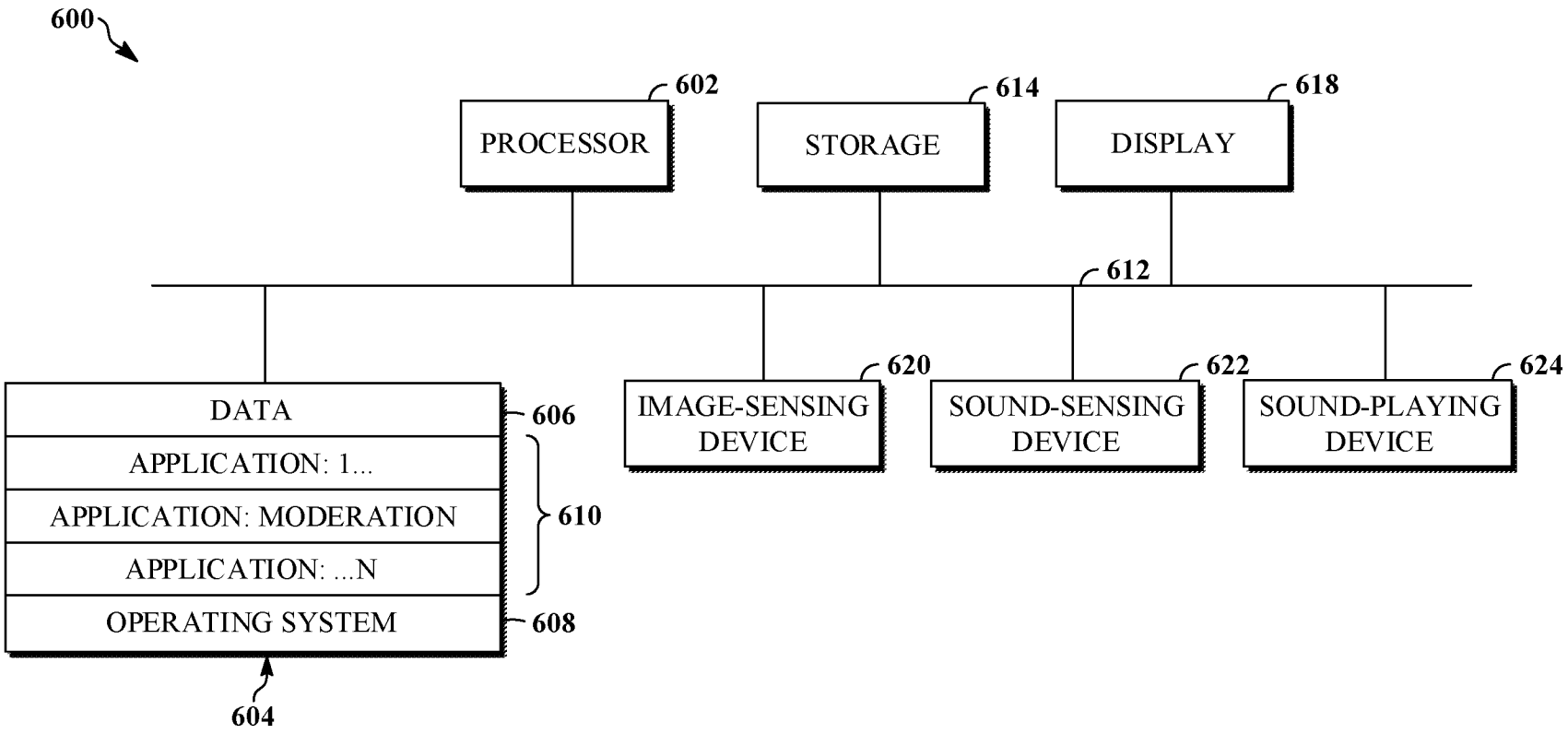
FIG. 6 is a block diagram of an example of a computing device in accordance with implementations of this disclosure.

Each of the modules of the apparatus 100 can be implemented, for example, as one or more software programs that may be executed by computing devices, such as a computing device 600 of FIG. 6. The software programs can include machine-readable instructions that may be stored in a memory such as the memory 604 or the secondary storage 614, and that, when executed by a processor, such as the processor 602, may cause the computing device to perform the functionality of the respective modules. The apparatus 100, or one or more the modules therein, can be, or can be implemented using, specialized hardware or firmware. Multiple processors, memories, or both, may be used.

FIGS. 2A-2D are examples of details of feature exaction from an audio frame according to implementations of this disclosure.

Figure 2A:
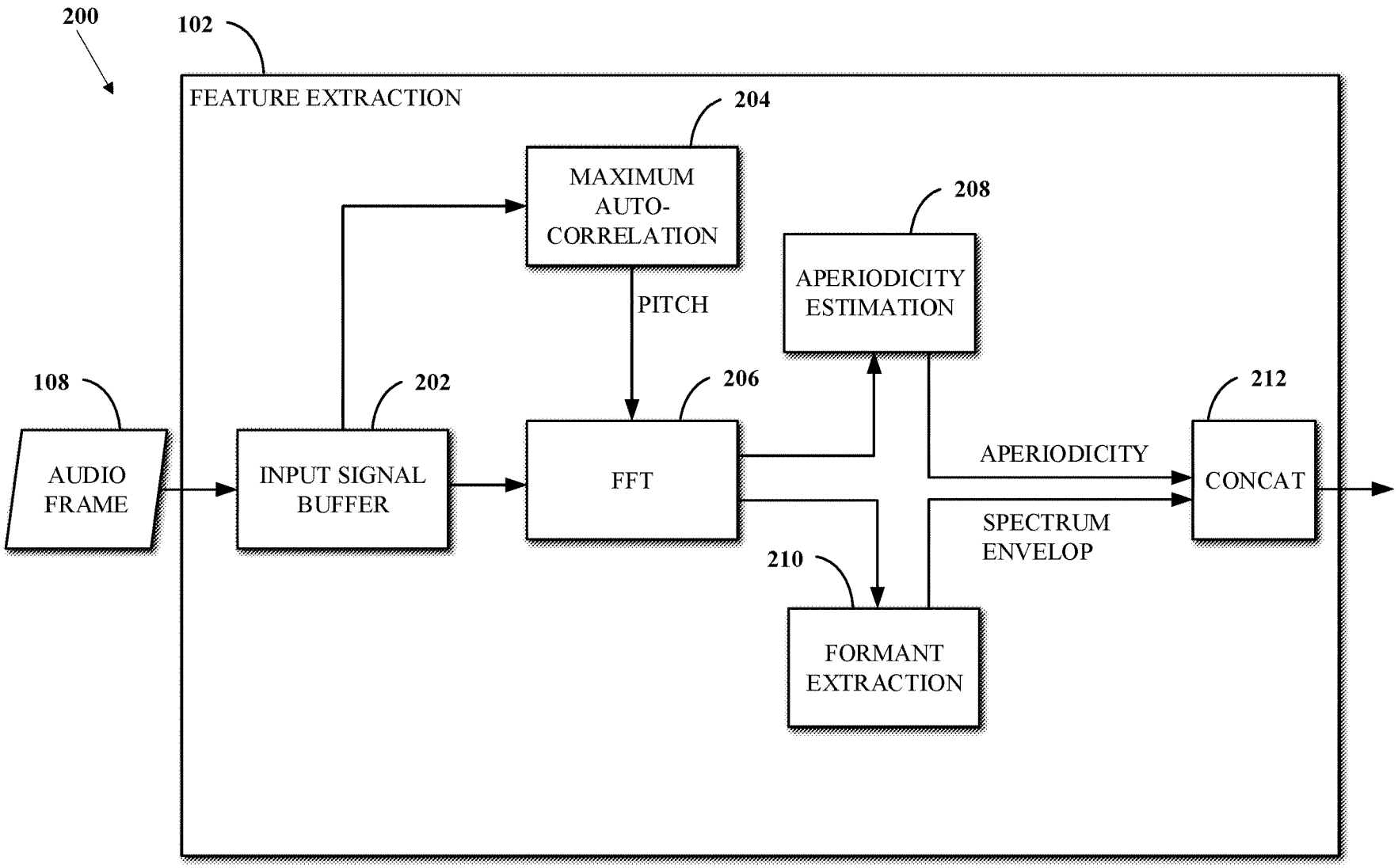
FIG. 2A is a flowchart of a technique for feature extraction module according to an implementation of this disclosure.

FIG. 2A is a flowchart of a technique 200 for feature extraction module according to an implementation of this disclosure. The technique 200 can be implemented by the feature extraction module 102 of FIG. 1. The technique 200 includes a pitch detection block (i.e., a formant extraction block 210), which can detect the pitch based on an autocorrelation technique that can be implemented by an autocorrelation block 204; and an aperiodicity estimation block 208 that extracts aperiodicity features of the source audio frame 108. The formant extraction block 210 can extract the formant information based on a spectrum smoothing technique, as further described below.

For each source audio frame 108 of a speech signal, the pitch detection block (i.e., the formant extraction block 210) can calculate a pitch value (F0). The pitch value can be used to determine window lengths of Fast Fourier Transforms (FFTs) 206 used by the formant extraction block 210 and the aperiodicity estimation block 208. The FFT 206 can also be used to determine audio signal lengths needed to perform the FFT. As further described below, the lengths can be 2*T0 and 3*T0 for aperiodicity estimation and formant extraction, respectively, where T0 depends on the pitch F0 (e.g., T0=1/F0). In an example, the feature extraction module 102 can search for the pitch value (F0) within a pitch search range. In an example, the pitch search range can be 75 Hz to 800 Hz, which covers the normal range of human pitch. The pitch value (F0) can be found by the autocorrelation block 204, which performs the autocorrelation on portions of the signal stored in a signal buffer 202. The length of the signal buffer 202 can be at least 40 ms, which can be determined by the lowest pitch (75 Hz) of the pitch detection range. The signal buffer 202 can include sampled data of at least 2 frames of the source audio signal. The signal buffer 202 can be used to store audio frames for a certain total length (e.g., 40 ms).

The feature extraction module 102, via a concatenation block 212, can provide the formant (i.e., the spectrum envelope) and aperiodicity information to the singing synthesis module 106, as shown in FIG. 1.

Figure 2B:
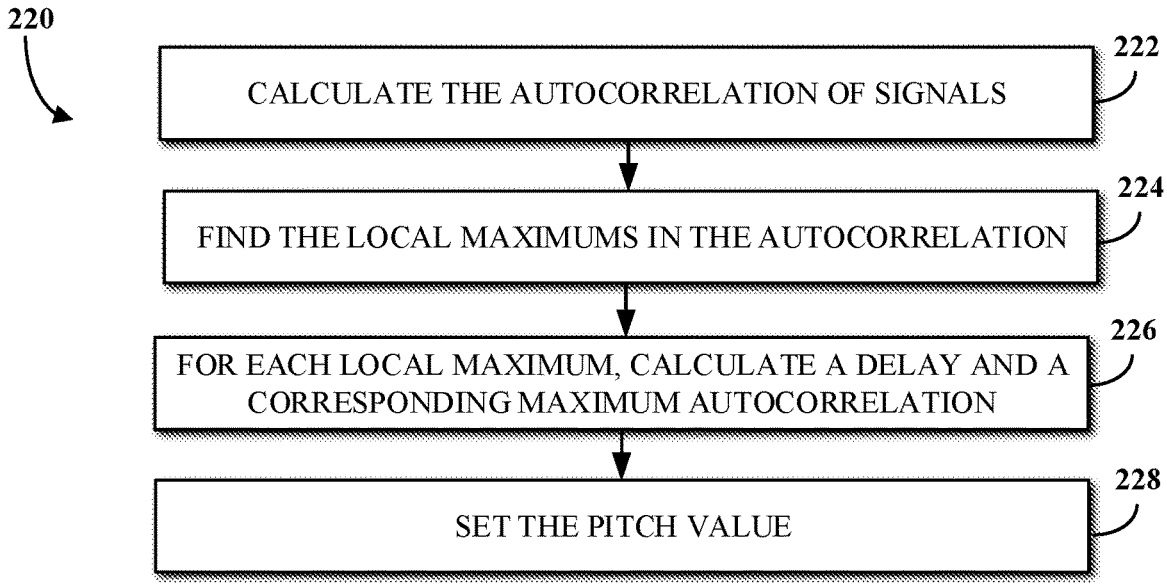
FIG. 2B is a flowchart of a technique for pitch value calculation according to an implementation of this disclosure.

FIG. 2B is a flowchart of a technique 220 for pitch value calculation according to an implementation of this disclosure. The technique 220 can be implemented by the autocorrelation block 204 of FIG. 2A to obtain the pitch value (F0). More specifically, the pitch value (F0) can be calculated (e.g., detected, selected, identified, chosen, etc.) using the autocorrelation technique (i.e., the technique 220).

At 222, the technique 220 calculates an autocorrelation of signals in the signal buffer. Autocorrelation can be used to identify patterns in data (such as time series data). An autocorrelation function can be used to identify correlations between pairs of values at a certain lag. For example, a lag-1 autocorrelation can measure the correlation between immediate neighboring data points; and a lag-2 autocorrelation can measure the correlation between pairs of values that are 2 periods (i.e., 2 time distances) apart. The autocorrelation can be calculated using formula (1):

$$r_n = r(n\Delta T) \tag{1}$$

In formula (1), r( ) is the auto-correlation function used to calculate autocorrelation with different time delays (e.g., nΔT); Δτ is the sampling time. For example, given a sampling frequency $f_s$ of the source audio frame 108 of 10 K, then Δτ would be 0.1 milliseconds (ms); and n can be in the range of [12, 134], which corresponds to the pitch search range.

At 224, the technique 220 finds (e.g., calculates, determines, obtains, etc.) the local maxima in the autocorrelation. In an example, the local maxima in the autocorrelation can be found between each (m−1)Δτ and (m+1)Δτ, where m has the same range as n. That is, within all of the calculated $r_n$'s, local maxima $r_m$'s are determined. Each local maximum $r_m$ is such that:

$$r_m > r_{m+1} \text{ and } r_m > r_{m-1} \tag{2}$$

At 226, for each local maximum $r_m$, a corresponding time position within the frame of a local maximum ($\tau_{max}$), and an interpolated value of the autocorrelation local maximum ($r_{max}$) are calculated using formulae (3) and (4), respectively. $\tau_{max}$ can be the delay with a maximum autocorrelation ($r_{max}$). However, other ways of finding $\tau_{max}$ and $r_{max}$ are possible.

$$\tau_{max} = \Delta\tau\left(m + \frac{0.5*(r_{m+1} - r_{m-1})}{2r_m - r_{m-1} - r_{m+1}}\right) \tag{3}$$

$$r_{max} = r_m + \frac{(r_{m+1} - r_{m-1})^2}{8(2r_m - r_{m-1} - r_{m+1})} \tag{4}$$

At 228, the technique 220 sets (e.g., calculates, selects, identifies, etc.) the pitch value (F0). In an example, if there exists a local maximum with $r_{max}$>0.5, then the pitch value can be calculated using the $\tau_{max}$ with the largest $r_{max}$ using formula (5) and set a flag Pitch_flag to true; otherwise (i.e., If there is no local maximum $r_{max}$>0.5), F0 can be set to a predefined value and the Pitch_flag is set to false. The predefined value can be a value in the pitch detection range, such as the middle of the range. In another example, the predefined value can be 75, which is the lowest pitch of the pitch detection range).

$$F0 = \begin{cases} \dfrac{1}{\tau_{max}} & \text{if } \exists\ r_{max} > 0.5 \\ 75 & \text{otherwise} \end{cases} \tag{5}$$

Figure 2C:
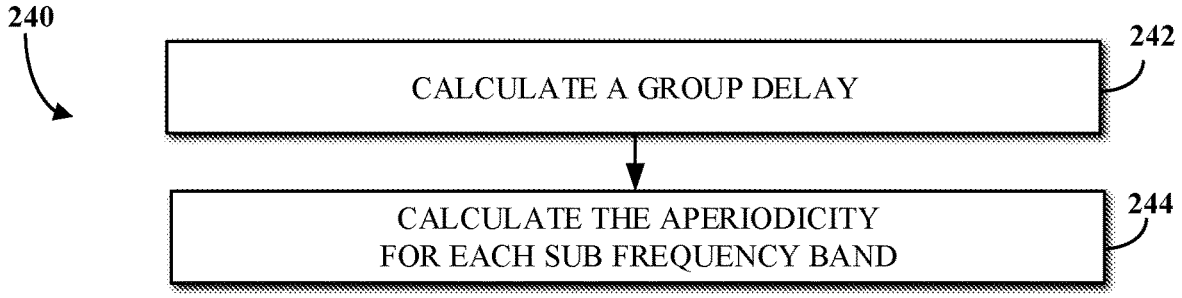
FIG. 2C is a flowchart of a technique for aperiodicity calculation according to an implementation of this disclosure.

FIG. 2C is a flowchart of a technique 240 for aperiodicity calculation according to an implementation of this disclosure. The aperiodicity is calculated based on a group delay. The technique 240 can be implemented by the aperiodicity estimation block 208 of FIG. 2A to obtain band aperiodicity (i.e., the aperiodicities of least some frequency sub bands) of the source audio frame 108.

At 242, the technique 240 calculates the group delay. The Group delay represents (e.g., describes, etc.) how the spectral envelope is changing at (e.g., within) different time points. As such, the group delay of the source audio frame 108 can be calculated as follows.

For each frame, use the signal s(t) of length (2*T0) to calculate the group delay, TD, where T0=1/F0. The group delay is defined through the equation (6):

$$\tau_D(\omega) = \frac{\Re(S'(\omega))\Im(S(\omega)) - \Re(S(\omega))\Im(S'(\omega))}{|S(\omega)|^2} \tag{6}$$

In equation (6), ℜ and ℑ represent, respectively, the real and imaginary parts of a complex value; and S(ω) represents the spectrum of the signal s(t) and the S'(ω) is a weighted spectrum calculated using formula (7) where $\mathcal{F}$ represents the Fourier transform:

$$S'(\omega)=\mathcal{F}[-jts(t)] \tag{7}$$

At 244, the technique 240 calculates the aperiodicity for each sub frequency band using the group delay. The whole vocal frequency range (i.e., [0-15] kHz) can be separated into a predefined number of frequency bands. In an example, the predefined number of frequency bands can be 5. However other numbers are possible. Thus, in an example, the frequency bands can be the sub-bands [0-3 kHz], [3 kHz-6 kHz], [6 kHz-9 kHz], [9 kHz-12 kHz], and [12 kHz-15 kHz]. However other partitions of the vocal frequency range are possible. Aperiodicities $ap(\omega_c^i)$ of the sub frequency bands can be calculated using equations 8-10.

$$p(t, \omega_c^i) = \mathcal{F}^{-1}\left[w(\omega)\tau_D\left(\omega - \left(\omega_c^i - \frac{w_l}{2}\right)\right)\right] \tag{8}$$

$$P_c(t, \omega_c^i) = 1 - \int_0^t p_s(\lambda, \omega_c^i)d\lambda \tag{9}$$

$$ap(\omega_c^i) = \begin{cases} -10\log_{10}(P_c(2w_{bw}, \omega_c^i)) & \text{if Pitch_flag = TRUE} \\ 1 & \text{if Pitch_}falg\text{ = FALSE} \end{cases} \tag{10}$$

In the equations 8-10, $\omega_c^i=2\pi f_c^i$ where $f_c^i$ is the center frequency of i the sub frequency band; w(ω) is a window function; $w_l$ is the window length (which can be equal to 2 times the sub frequency bandwidth); and $\mathcal{F}^{-1}$ is the inverse Fourier transform. Thus, the waveform $p(t, \omega_c^i)$ can be calculated using the inverse Fourier transform. With respect to the parameter $P_c(t, \omega_c^i)$ (equation (9)), $p_s(t, \omega_c^i)$ represents a parameter calculated by sorting the power waveform $|p(t, \omega_c^i)|^2$ in descending order in the time axis. In equation (10), $w_{bw}$ represents the main-lobe bandwidth of the window function w(ω), which has dimension of time. Since the main-lobe bandwidth can be defined as the shortest frequency range from 0 Hz to the frequency at which the amplitude indicates 0, $2w_{bw}$ can be used.

In an example, a window function with a low side lobe can be used to prevent data from being aliased (or copied) in the frequency domain. For example, a Nuttall window can be used as this window function has a low side lobe. In another example, a Blackman window can be used.

Figure 2D:
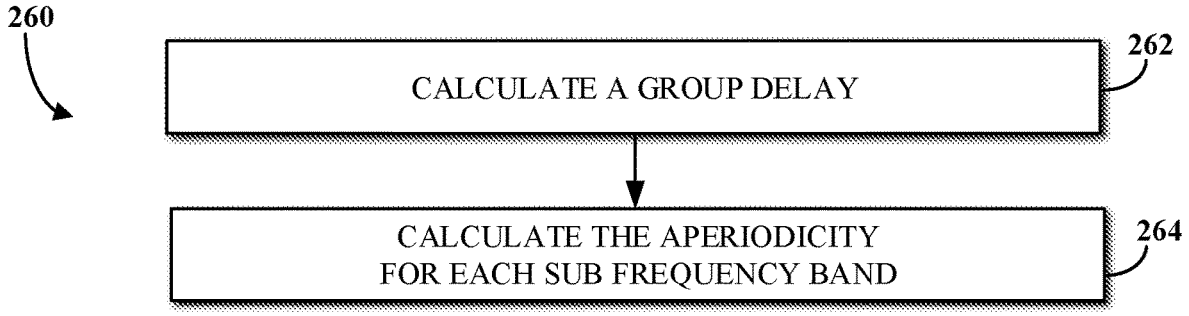
FIG. 2D is a flowchart of a technique for formant extraction according to an implementation of this disclosure.

FIG. 2D is a flowchart of a technique 260 for formant extraction according to an implementation of this disclosure. The technique 260 can be implemented by the formant extraction block 210 of FIG. 2A to obtain formant information of the source audio frame 108. The formant information can be represented by the spectrum envelope (e.g., a smoothed spectrum). A filtering function can be applied to the cepstrum of the windowed signal to smoothen the magnitude spectrum. As the human voice or speech signals can have sidebands, the cepstrum can be used, in speech processing, to understand (e.g., analyze, etc.) differences between pronunciations and different words. Cepstrum is a technique by which a group of side bands coming from one source can be clustered as a single parameter. However, other ways of extracting the formant information are possible.

At 262, the technique 260 calculates power cepstrum from the windowed signal. As is known, the cepstrum of a signal is the inverse Fourier transform of the Fourier transform of the signal and its logarithm of that Fourier transform. The length of the window can be 3*T0, where T0=1/F0, as described above. As the cepstrum is obtained using an inverse Fourier, the cepstrum is in the time domain. The power cepstrum can be calculated using formula (11) using a Hamming window w(t):

$$p_s(t)=\mathcal{F}^{-1}[\log(|\mathcal{F}\{s(t)*w(t)\}|^2)] \tag{11}$$

At 264, the technique 260 calculates the smoothed spectrum (i.e., the formant) from the cepstrum using equation (12):

$$P(\omega) = \exp\left(\mathcal{F}\left[\frac{\sin(\pi tF0)(1.18 - 0.18*\cos(\pi tF0))}{\pi tF0} p_s(t)\right]\right) \tag{12}$$

The constants 1.18 and 0.18 are empirically derived to obtain a smooth formant. However, other values are possible.

Turning now to the singing feature generation module 104 of FIG. 1, and as eluded to above, the singing feature generation module 104 can operate in a static mode or in a dynamic mode. The singing feature generation module 104 can obtain (e.g., use, calculate, derive, select, etc.) the tonic pitch and chord pitches (e.g., zero or more chord pitches) to be used to convert the source audio frame 108 to the singing audio frame 112.

Figure 3A:
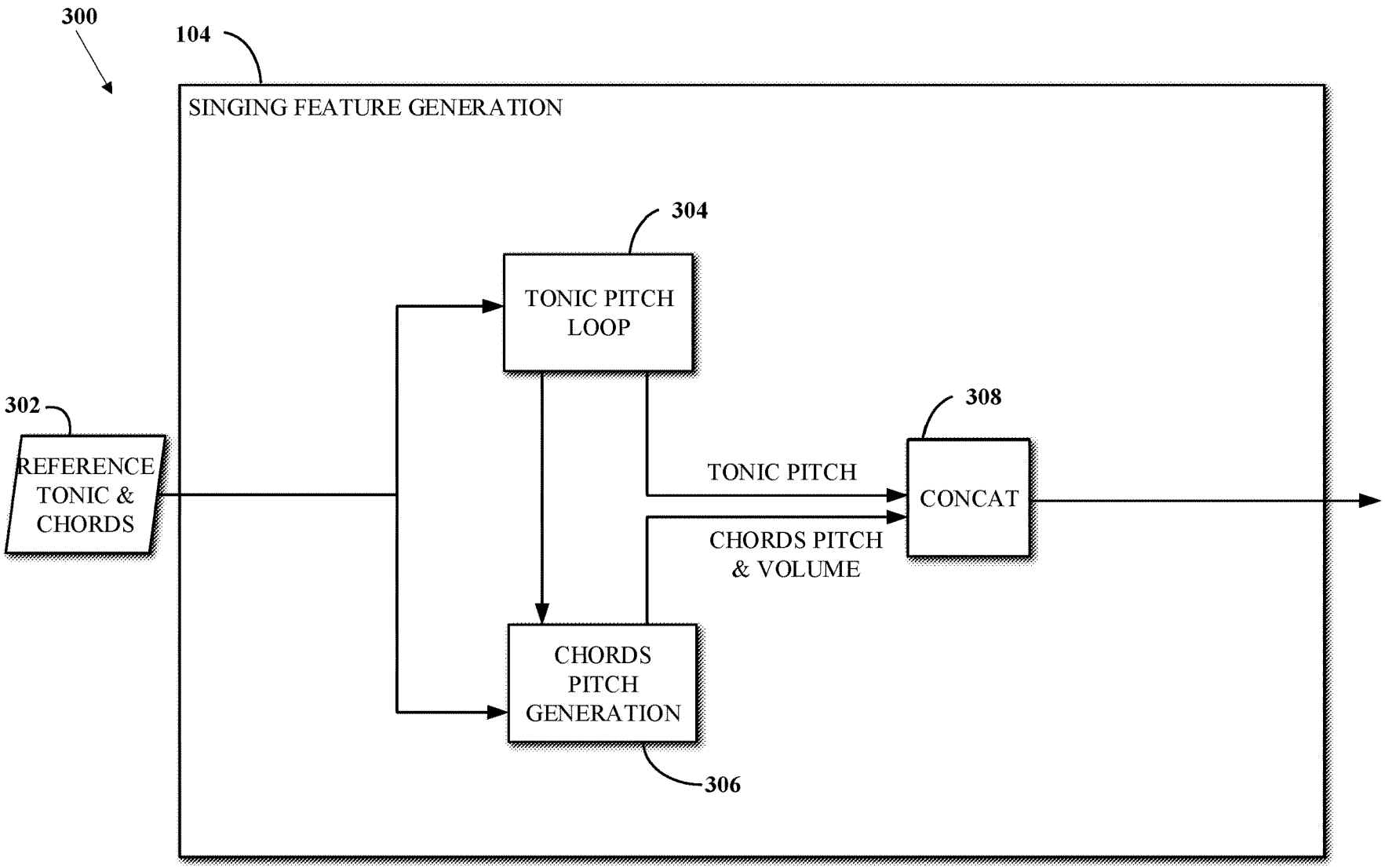
FIG. 3A is a flowchart of a technique for singing feature generation in a static mode according to an implementation of this disclosure.

FIG. 3A is a flowchart of a technique 300 for singing feature generation in a static mode according to an implementation of this disclosure. The technique 300 can be implemented by the singing feature generation module 104 of FIG. 1. In the static mode, the reference signal 110 of FIG. 10 (i.e., a reference 302) is provided to the singing feature generation module 104 before the real-time speech to singing conversion is performed on an input speech signal.

In an example, the reference 302 can be a Musical Instrument Digital Interface (MIDI) file. A MIDI file can contain the details of a recording to a performance (such as on a piano). The MIDI file can be thought of as containing a copy of the performance. For example, a MIDI file would include the notes played, the order of the notes, the length of each played note, whether (in the case of piano) a pedal is pressed, and so on. FIG. 3C illustrates a visualization 360 of an example of a MIDI file. For example, a lane 362 shows where the E2 note is played, in relation to other notes, and the durations of each of the E2 notes.

In an example, the reference 302 can be a pitch trajectory file. FIG. 3D illustrates a visualization 370 of a pitch trajectory file. The visualization 370 illustrates the pitches (the vertical axis) to be used with each frame of an audio file (the horizontal axis). A solid graph 372 illustrates the tonic pitch; a dotted graph 374 illustrates a first chord pitch; and a dot-dashed graph 376 illustrates a second chord pitch.

In the static mode, the singing feature generation module 104 (e.g., tonic pitch loop block 304 therein) repetitively provides the tonic pitch at each frame according to a preset pitch trajectory as described (e.g., configured, recorded, set, etc.) in the reference 302. When all the all the pitches of the reference 302 are exhausted, the tonic pitch loop block 304 restarts with the first frame of the reference 302. In an example, the reference 302 (e.g., a MIDI file) can also include chords pitches. As such, a chord pitch generation block 306 can also use the reference 302 to obtain the chord pitches (e.g., one or more chord pitches) per frame. In another example, the chord pitch generation block 306 can obtain (e.g., derive, calculate, etc.) the chord pitches using a chord rule, such as triad, perfect fifth, or some other rule. An example of chord pitches using the perfect fifth rule is shown in FIG. 3E. FIG. 3E illustrates a visualization 380 of the perfect fifth rule. A dotted graph 382 illustrates the tonic pitch; a dashed graph 384 illustrates a first chord pitch; and a long-dash-short-dash graph 386 illustrates a second chord pitch.

For each frame of the source audio frame 108, a concatenation block 308 concatenates the tonic pitch and the chords pitches to provide to the singing synthesis module 106 of FIG. 1.

Figure 3B:
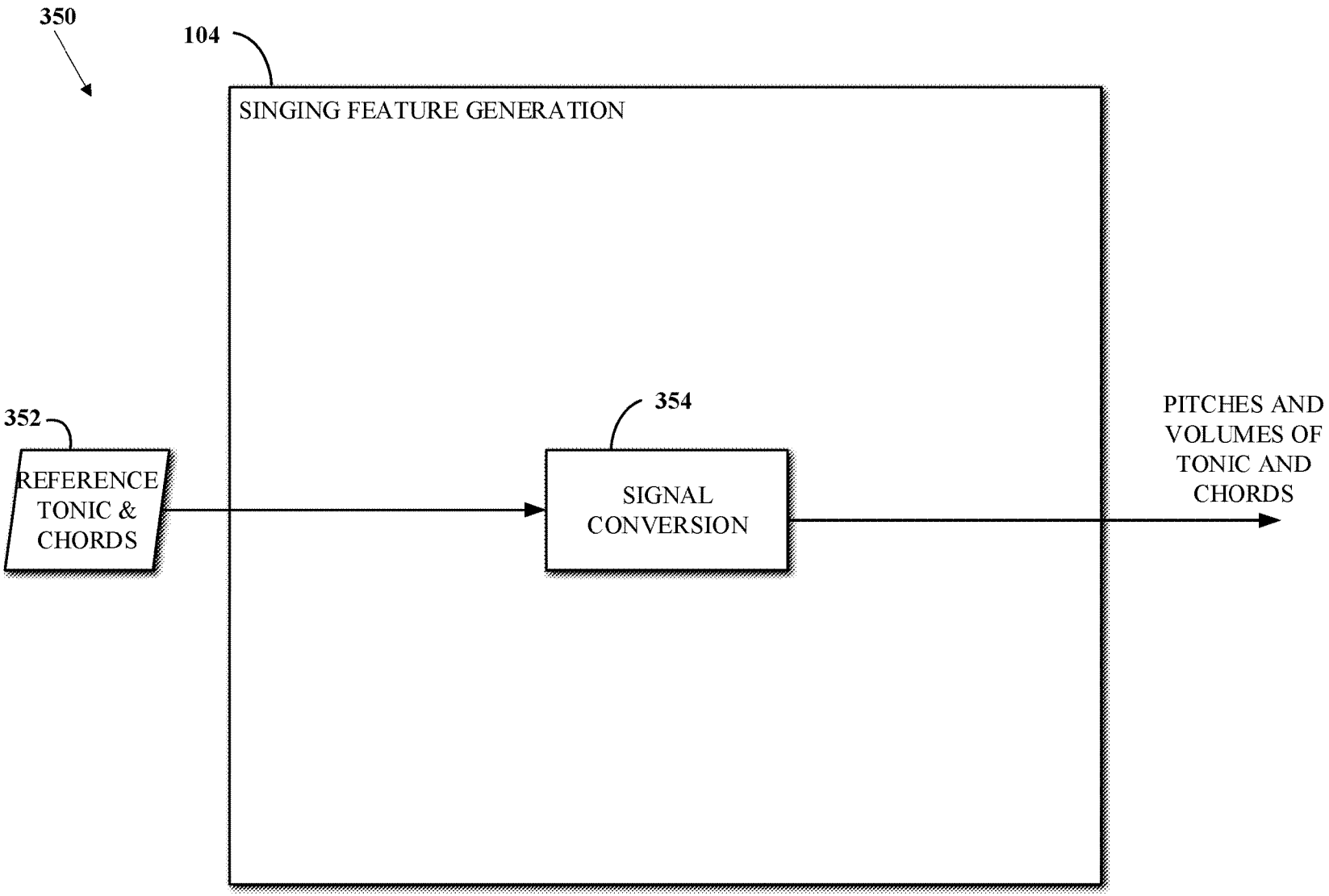
FIG. 3B is a flowchart of a technique for singing feature generation in a dynamic mode according to an implementation of this disclosure.
Figure 3C:
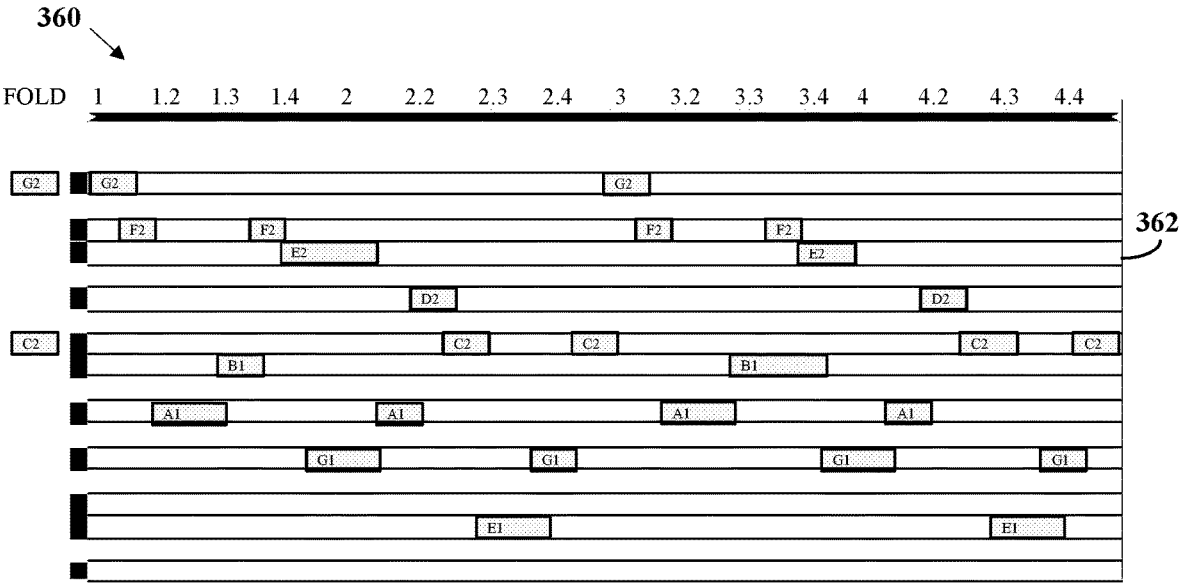
FIG. 3C illustrates a visualization of an example of a MIDI file.
Figure 3D:
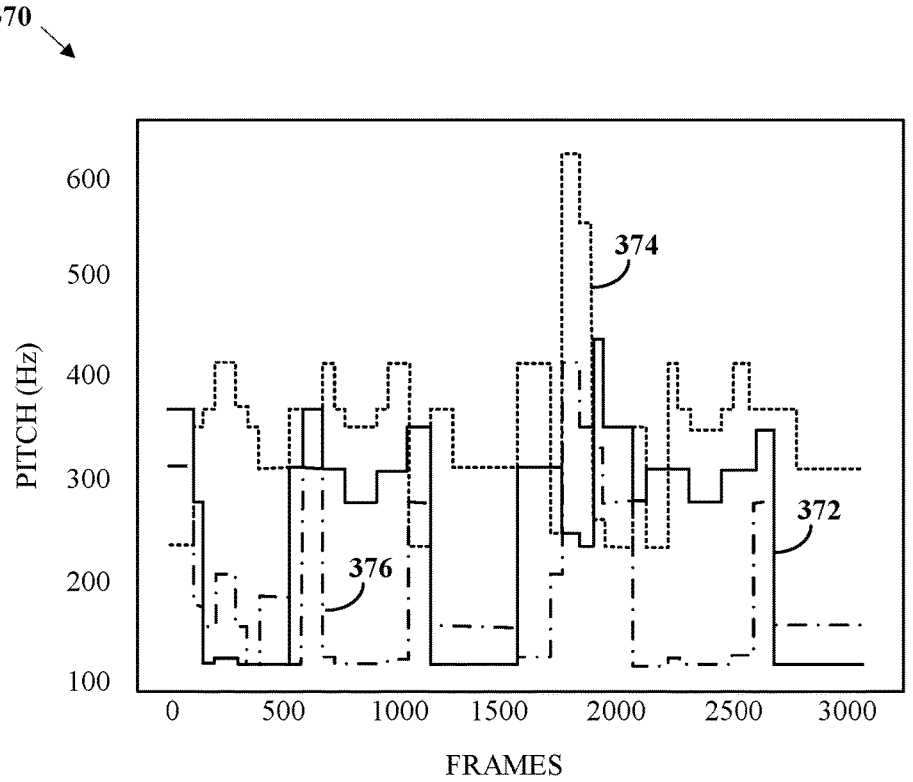
FIG. 3D illustrates a visualization of a pitch trajectory file.
Figure 3E:
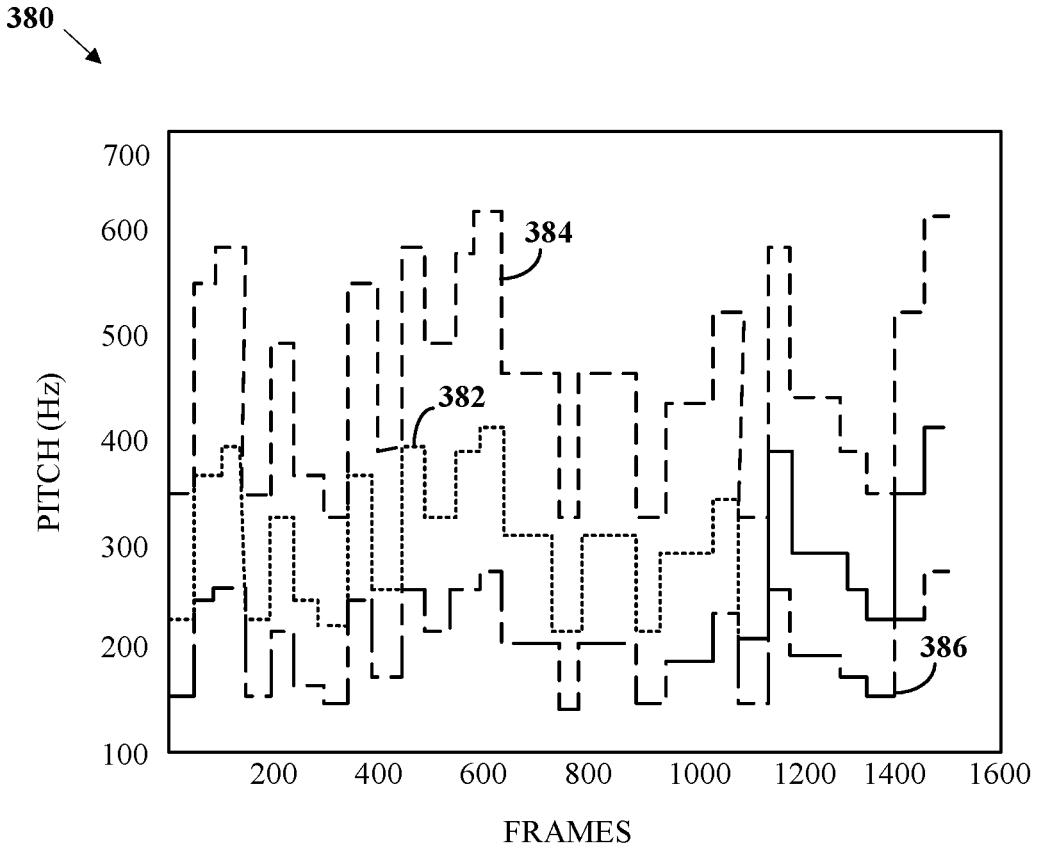
FIG. 3E illustrates a visualization of the perfect fifth rule.

FIG. 3B is a flowchart of a technique 350 for singing feature generation in a dynamic mode according to an implementation of this disclosure. The technique 350 can be implemented by the singing feature generation module 104 of FIG. 1 in a dynamic mode. In the dynamic mode, the tonic and chords pitches are provided in real-time by a virtual instrument (such as a virtual keyboard, a virtual guitar, or some other virtual instrument) that may be played on a portal device (such as using a smartphone touch screen) or a digital instrument (such as an electric guitar, or the like). In another example, a background music composition may be playing in the background while the user is speaking. As such, a user may be able to "play" his/her vocal in whatever melody he/she plays the instrument. A signal conversion block 354 can extract frame-by-frame tonic and chords pitches from the playing music, in real time, to provide to the singing synthesis module 106 of FIG. 1. In an example, a stream (e.g., a MIDI stream) containing the pitch and the volume may be obtained by the signal conversion block 354 from which the frame-by-frame tonic and chords pitches can be extracted. For example, an instrument being played or a software used to play music (e.g., an instrument) may support and stream the MIDI stream containing the pitch and volume.

It is noted that the normal human tonic pitch is distributed from 55 Hz to 880 Hz. Thus, in an example, and to achieve a natural singing voice, the tonic and chord pitches can be assigned within the range of the normal human tonic pitch. That is, the tonic and/or chord pitches can be clamped to within the range [55, 880]. For example, if the pitch is less than 55 Hz, then it can be set (e.g., clipped) to 55 Hz; and if it is greater than 880, then it can be set (e.g., clipped) to 880. In another example, as clipping may produce unharmonic sounds, a pitch that is outside of the range is not produced.

Figure 4:
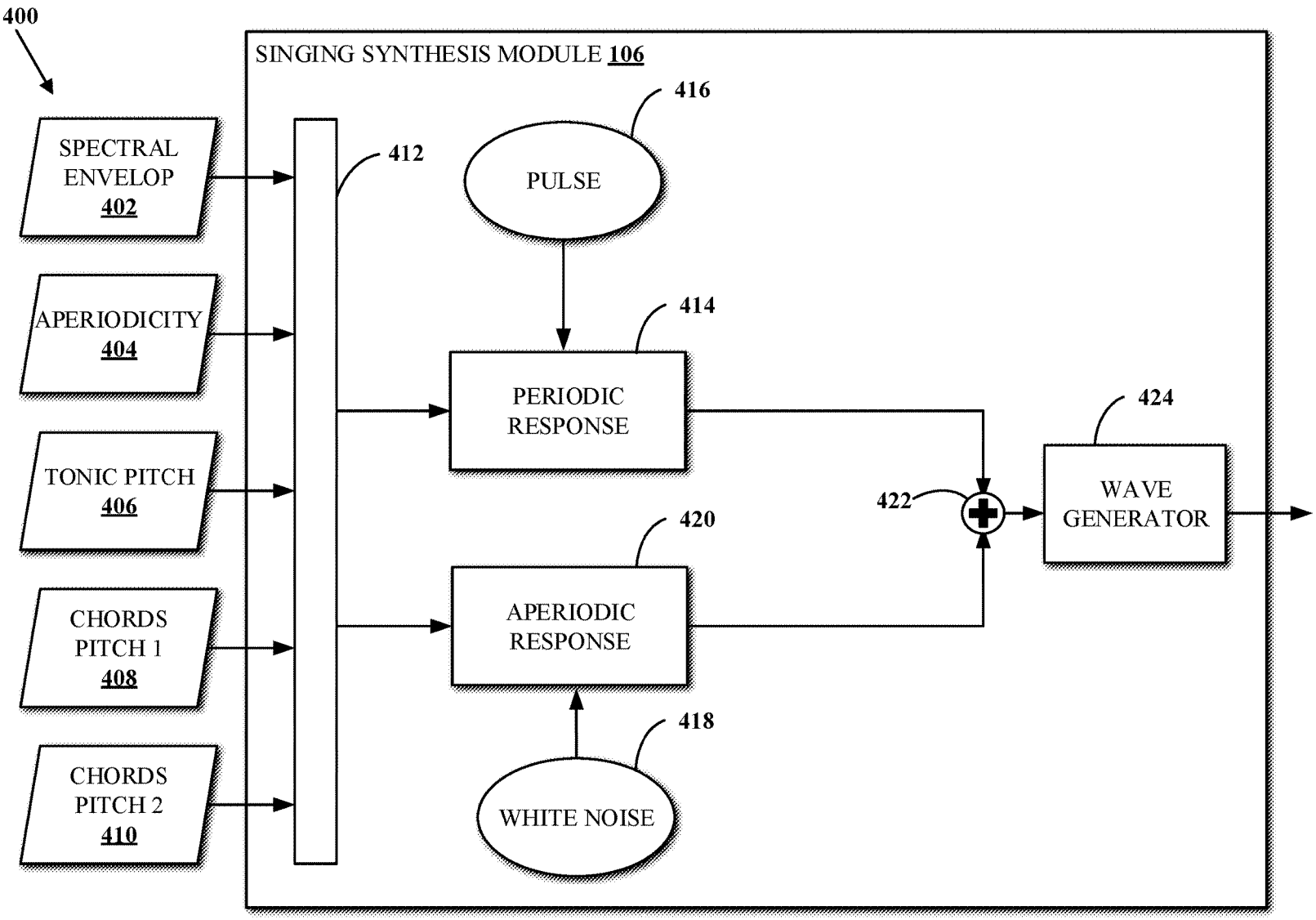
FIG. 4 is a flowchart of a technique for singing synthesis according to an implementation of this disclosure.

FIG. 4 is a flowchart of a technique 400 for singing synthesis according to an implementation of this disclosure. The technique 400 can be implemented by the singing synthesis module 106 of FIG. 1. The technique 400 can receive, at an input layer 412, a spectrum envelop 402 (i.e., the formant) and an aperiodicity 404, which are obtained from the feature extraction module 102. The technique 400 can also receive the tonic pitch 406 and zero or more chords pitches (such as first chord pitch 408 and a second chord pitch 410) from the singing feature generation module 104. The technique 400 uses these inputs to generate the singing signal, frame by frame (i.e., the singing audio frame 112).

The technique 400 generates two kinds of sounds: a periodic sound, which can be generated from a pulse signal block (i.e., a block 416), and a noise signal block (i.e., a block 418). A pulse signal is a rapid, transient change in the amplitude of a signal followed by a return to a baseline value. For example, a clap sound injected into, or is within, a signal can be an example of the pulse signal.

At block 416, pulse signals $S_{pulse}^{i}$ are prepared and, at block 418, white noise signals $S_{noise}^{i}$ are prepared (e.g., calculated, derived, etc.) for at least some (e.g., each) of the frequency sub-bands (e.g., the five sub-bands described above). As such, a respective pulse signal and noise signal can be obtained for at least some (e.g., each) of the frequency sub-bands.

The pulse signals can be used by a block 414 to generate a period response (i.e., a periodic sound).

The pulse signals $S_{pulse}^{i}$ can be obtained using any known technique. In an example, the pulse signals $S_{pulse}^{i}$ can be calculated using equations (13)-(14).

$$Spec^{i}_{Pluse}(j) = \begin{cases} a + \pi\cos\left(\frac{(f(j) - (b*i))}{c}\right) & f(j) \in ith \text{ sub frequency band} \\ 0 & \text{otherwise} \end{cases} \tag{13}$$

$$S^{i}_{pulse} = \mathcal{F}^{-1}(Spec^{i}_{Pulse}) \tag{14}$$

In equation (13), which obtains the frequency domain pulse signals for each sub-band, the index i represents the sub frequency bands and the index j represents the frequency bins. The parameters a, b, and c can be constants that are imperially derived. In an example, the constants a, b, and c can have the values 0.5, 3000, and 1500, respectively, which result in pulse signals that approximate the human voice. f(j) is the frequency of $j^{th}$ frequency bin of the pulse signal spectrum—the range of f(j) can be the full frequency band (e.g., 0-24 kHz). To illustrate, if the $i^{th}$ frequency band is 150-440 Hz, then $Spec_{Pulse}^{i}$ (j) would have some value when f(j) is within 150-440 Hz, and equal to 0 if f(j) is not in the range. Equation (14) obtains the time domain pulse signals for each frequency sub-band by performing an inverse Fourier transform. Thus, for each frequency bin of a frequency sub-band, a respective pulse spectrum is obtained; and these pulse spectra are combined into a time domain pulse signal.

The noise signals $S_{noise}^{i}$ can be obtained, by a block 420, using any known technique. In an example, the noise signals $S_{noise}^{i}$ can be calculated using equations (15)-(17).

$$Spec_{noise_{all}}(j) = \mathcal{F}\left[\cos(2\pi x_2)\sqrt{-2*\log_{10}(x_1)}\right] \tag{15}$$

$$Spec^{i}_{noise} = \begin{cases} Spec_{noise_{all}}(j) & f(j) \in ith \text{ sub frequency band} \\ 0 & \text{otherwise} \end{cases} \tag{16}$$

$$S^{i}_{noise} = \mathcal{F}^{-1}(Spec^{i}_{noise}) \tag{17}$$

The spectrum noise (i.e., white noise), $Spec_{noise_{all}}$(j), for the frequency bins (indexes with j) is obtained using equation (15), where $x_1$ and $x_2$ are random number vectors valued from [0,1] with a length equal to half of the sampling frequency ($0.5f_s$). Equation (15) separates the spectrum noise, $Spec_{noise_{all}}$, into respective sub-bands noise. That is, equation (15) separates the spectrum noise into different sub-bands. Equation (17) obtains the noise wave signal from the spectrum signal by performing an inverse Fourier transform.

A block 414 can calculate locations within the source audio frame 108 where pulses should be added (e.g., started, inserted, etc.). Pitch values for each sampled point of the source audio frame 108 are first obtained. For a current source voice frame (i.e., frame k) (i.e., the source audio frame 108), the pitch value for each sampled point, j (i.e., the timing index), of the frame k, an interpolated pitch value $F0^{int}$(j) can be obtained using the pitch value of the previous frame. That is $F0^{int}(j)$ can be obtained by interpolating F0(k) and F0(k−1). The interpolation can be a linear interpolation. To illustrate, assume, for example, that F0(k)=100 and F0(k−1)=148 and that there are 480 sampled points in each frame, then the interpolated pitch values $F0^{int}(j)$ for kth frame can be [147.9, 147.8, . . . , 100] for j=1, . . . , 480.

Given a frame size of $F_{size}$ samples and a sampling frequency of $f_s$, each of the sampling locations can be a potential pulse location. The pulse locations in the $k^{th}$ frame can be obtained by first obtaining a phase shift at sampling location j using equation 18, which calculates the phase modulo (MOD) 2π. The phase can be in the range of [−π, π]. As illustrated by the pseudocode of Table I, if the phase difference between a current timing point (j) and its immediate successor timing point (j+1) is greater than π, then the current timing point is identified as a pulse location. Thus, there could be 0 or more places in just one frame, depending on the pitch, where pulses are added. When the phase difference is large (e.g., greater than π), a pulse can be added to avoid phase discontinuities.

TABLE I $$PW_k^j = \mathrm{Mod}\left[\sum_{i=1}^{j} 2\pi F0^{\mathrm{int}}(j)/f_s) + PW_{k-1}^j,\ 2\pi\right] \tag{18}$$

```
s = 1                    //counter of pulse locations within a frame
for j = 1 to F_size
  if |PW_k^j − PW_k^(j+1)| > π then
    PL_k^s = j           //set the timing location j as a pulse location
  s = s + 1
```

At a block 422, an excitation signal is obtained by combining (e.g., mixing, etc.), at each pulse location, a corresponding pulse and noise signal. The amounts of pulse signal and noise signal used is based on the aperiodicity. The aperiodicity in each sub-band, $ap(\omega_c^i)$, can be used as a percentage apportionment of pulse to noise ratio in the excitation signal. The excitation signal, $S_{ex}[PL_k^s]$, where s indicates the pulse location and k indicates the current frame, can be obtained using equation (19).

$$S_{ex}[PL_k^s] = \sum_{i=1}^{n} (1 - ap(\omega_c^i))S_{pulse}^i + ap(\omega_c^i)S_{noise}^i \tag{19}$$

The excitation signal can be used by a block 424 (i.e., a wave-generating block) to obtain the singing audio frame 112. The excitation signal and the cepstrum, which is calculated as described above, are combined using equations (20)-(22) to obtain to generate the resultant wave signal, $S_{wav}$, which is the singing audio frame 112.

$$\mathrm{Cepstrum} = \mathcal{F}[\log_{10}(|P|)] \tag{20}$$

$$\mathrm{Cepstrum}_{complex}[k] = \begin{cases} \mathcal{R}(\mathrm{Cepstrum}[k]) * 2 & k > 1 \text{ and } k \le \frac{fft_{size}}{2} \\ \mathcal{R}(\mathrm{Cepstrum}[1]) & k = 1 \\ 0 & k > \frac{fft_{size}}{2} \end{cases} \tag{21}$$

$$S_{wav} = \mathcal{R}\left(\mathcal{F}^{-1}\left[10^{\mathcal{F}^{-1}[Cepstrum_{complex}]} * \mathcal{F}[w_{han} * S_{ex}]\right)\right) \tag{22}$$

Equation (20) obtains the Fourier transform of the smoothed spectrum (i.e., formant), which is calculated by the feature extraction module 102 as described above. In equation (21), $fft_{size}$ is the size of fast Fourier transform (FFT) which is the same as the FFT size used to calculate the smoothed spectrum. Equation (21) is an intermediate step used in the calculation of $S_{wav}$. In an example, $fft_{size}$ can equal to 2048 to provide enough frequency resolution. In equation (22), $w_{han}$ is a Hanning window.

Figure 5:
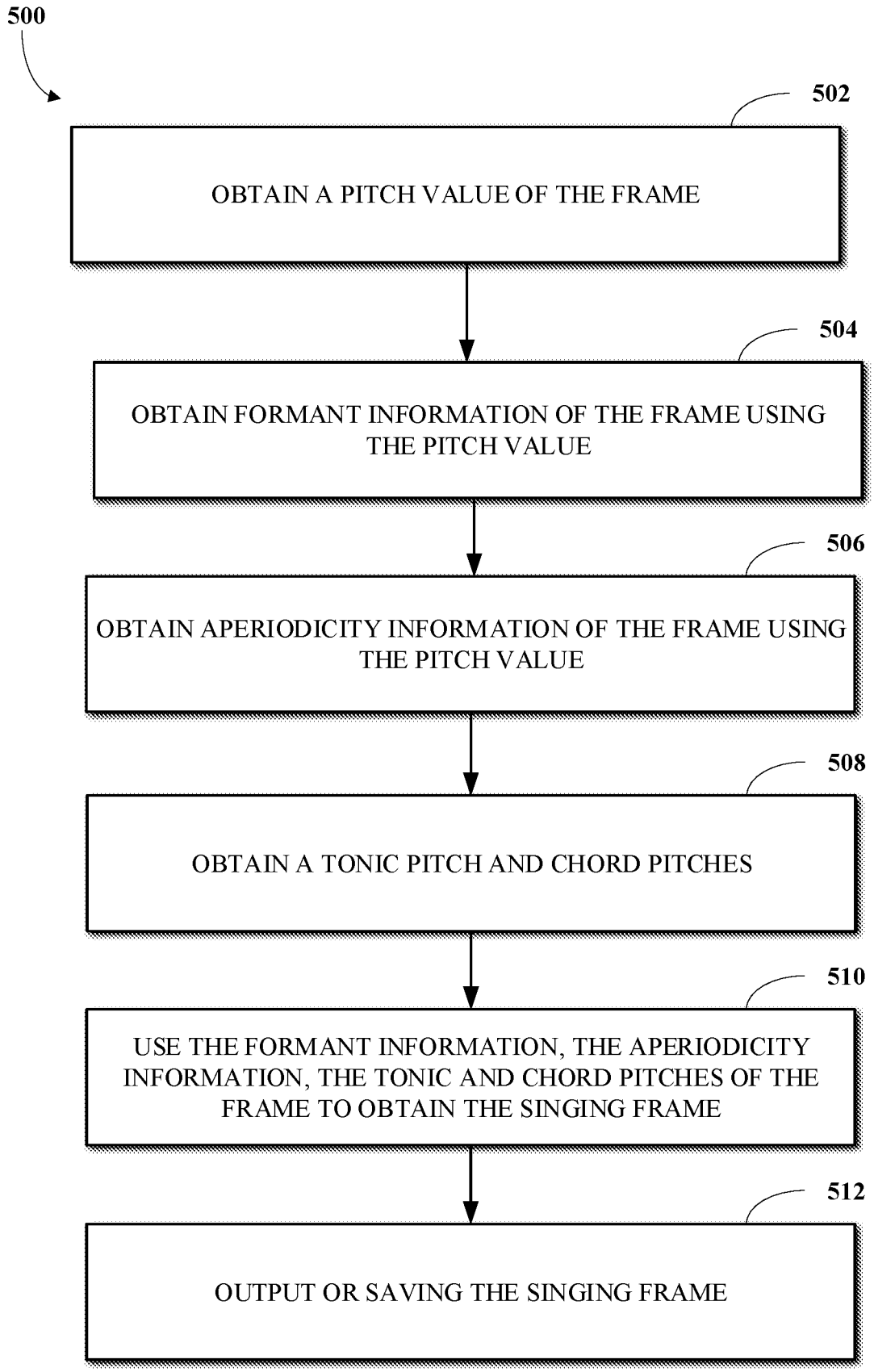
FIG. 5 is a flowchart of an example of a technique for speech to singing conversion according to an implementation of this disclosure.

FIG. 5 is a flowchart of an example of a technique 500 for speech to singing conversion according to an implementation of this disclosure. The technique 500 converts a frame of a voice (speech) sample to a singing frame. The frame of the voice sample can be as described with respect to the source audio frame 108 and the singing frame can be the singing audio frame 112 of FIG. 1.

The technique 500 can be implemented by an apparatus such as the apparatus 100 of FIG. 1. The technique 500 can be implemented, for example, as one or more software programs that may be executed by computing devices, such as a computing device 600 of FIG. 6. The software programs can include machine-readable instructions that may be stored in a memory such as the memory 604 or the secondary storage 614, and that, when executed by a processor, such as the processor 602, may cause the computing device to perform the technique 500. The technique 500 can be, or can be implemented using, specialized hardware or firmware. Multiple processors, memories, or both, may be used.

At 502, the technique 500 obtains a pitch value of the frame. The pitch value can be obtained as described above with respect to F0. As such, including the pitch value of the frame can include, as described above, calculating an autocorrelation of signals in a signal buffer; identifying local maxima in the autocorrelation; and obtaining the pitch value using the local maxima.

At 504, the technique 500 obtains formant information of the frame using the pitch value. Obtaining the formant information can be as described above. As such, obtaining the formant information of the frame using the pitch value can include obtaining a window length using the pitch value; calculating a power cepstrum of the frame using the window length; and obtaining the formant from the cepstrum.

At 506, the technique 500 obtains aperiodicity information of the frame using the pitch value. Obtaining the aperiodicity information can be as described above. As such, obtaining the aperiodicity information can include calculating a group delay using the pitch value; and calculating a respective aperiodicity value for each frequency sub-band of the frame.

At 508, the technique 500 obtains a tonic pitch and chord pitches to be applied to (e.g., combined with, etc.) the frame. In an example, at least one of the tonic pitch or chords pitches can be provided statically according to a preset pitch trajectory, as described above. In an example, the chord pitches are calculated using chord rules. In an example, the tonic pitch and chord pitches can be calculated in real-time from a reference sample. The reference sample, can be a real or virtual playing instrument concurrently with the speech.

At 510, the technique 500 uses the formant information, the aperiodicity information, and the tonic and chord pitches to obtain the singing frame. Obtaining the singing frame can be as described above. As such, obtaining the singing frame can include obtaining respective pulse signals for frequency sub-bands of the frame; obtaining respective noise signals for the frequency sub-bands of the frame; obtaining locations within the frame to inset the respective pulse signals and the respective noise signals; obtaining an excitation signal; obtaining the singing frame using the excitation signal.

At 512, the technique 500 outputs or saves the singing frame. For example, the singing frame may be converted to a savable format and stored for later playing. For example, the singing frame may be output to the sending user or the receiving user. For example, if the singing frame is generated using a sending user's device, then outputting the singing frame can mean transmitting (or causing to be transmitted) the singing frame to a receiving user. For example, if the singing frame is generated using a receiving user's device, then outputting the singing frame can mean outputting the singing frame so that it is audible by the receiving user.

FIG. 6 is a block diagram of an example of a computing device 600 in accordance with implementations of this disclosure. The computing device 600 can be in the form of a computing system including multiple computing devices, or in the form of one computing device, for example, a mobile phone, a tablet computer, a laptop computer, a notebook computer, a desktop computer, and the like.

A processor 602 in the computing device 600 can be a conventional central processing unit. Alternatively, the processor 602 can be another type of device, or multiple devices, capable of manipulating or processing information now existing or hereafter developed. For example, although the disclosed implementations can be practiced with one processor as shown (e.g., the processor 602), advantages in speed and efficiency can be achieved by using more than one processor.

A memory 604 in computing device 600 can be a read only memory (ROM) device or a random access memory (RAM) device in an implementation. However, other suitable types of storage devices can be used as the memory 604. The memory 604 can include code and data 606 that are accessed by the processor 602 using a bus 612. The memory 604 can further include an operating system 608 and application programs 610, the application programs 610 including at least one program that permits the processor 602 to perform at least some of the techniques described herein. For example, the application programs 610 can include applications 1 through N, which further include applications and techniques useful in real-time speech to singing conversion. For example the application programs 610 can include one or more of the techniques 200, 220, 240, 250, 300, 350, 400, or 500 or aspects thereof, to implement a speech to singing conversion. The computing device 600 can also include a secondary storage 614, which can, for example, be a memory card used with a mobile computing device.

The computing device 600 can also include one or more output devices, such as a display 618. The display 618 may be, in one example, a touch sensitive display that combines a display with a touch sensitive element that is operable to sense touch inputs. The display 618 can be coupled to the processor 602 via the bus 612. Other output devices that permit a user to program or otherwise use the computing device 600 can be provided in addition to or as an alternative to the display 618. When the output device is or includes a display, the display can be implemented in various ways, including by a liquid crystal display (LCD), a cathode-ray tube (CRT) display, or a light emitting diode (LED) display, such as an organic LED (OLED) display.

The computing device 600 can also include or be in communication with an image-sensing device 620, for example, a camera, or any other image-sensing device 620 now existing or hereafter developed that can sense an image such as the image of a user operating the computing device 600. The image-sensing device 620 can be positioned such that it is directed toward the user operating the computing device 600. In an example, the position and optical axis of the image-sensing device 620 can be configured such that the field of vision includes an area that is directly adjacent to the display 618 and from which the display 618 is visible.

The computing device 600 can also include or be in communication with a sound-sensing device 622, for example, a microphone, or any other sound-sensing device now existing or hereafter developed that can sense sounds near the computing device 600. The sound-sensing device 622 can be positioned such that it is directed toward the user operating the computing device 600 and can be configured to receive sounds, for example, speech or other utterances, made by the user while the user operates the computing device 600. The computing device 600 can also include or be in communication with a sound-playing device 624, for example, a speaker, a headset, or any other sound-playing device now existing or hereafter developed that can play sounds as directed by the computing device 600.

Although FIG. 6 depicts the processor 602 and the memory 604 of the computing device 600 as being integrated into one unit, other configurations can be utilized. The operations of the processor 602 can be distributed across multiple machines (wherein individual machines can have one or more processors) that can be coupled directly or across a local area or other network. The memory 604 can be distributed across multiple machines such as a network-based memory or memory in multiple machines performing the operations of the computing device 600. Although depicted here as one bus, the bus 612 of the computing device 600 can be composed of multiple buses. Further, the secondary storage 614 can be directly coupled to the other components of the computing device 600 or can be accessed via a network and can comprise an integrated unit such as a memory card or multiple units such as multiple memory cards. The computing device 600 can thus be implemented in a wide variety of configurations.

For simplicity of explanation, the techniques 200, 220, 240, 250, 300, 350, 400, or 500 of FIG. 2A, 2B, 2C, 2D, 3A, 3B, 4 or 5, respectively, are each depicted and described as a series of blocks, steps, or operations. However, the blocks, steps, or operations in accordance with this disclosure can occur in various orders and/or concurrently. Additionally, other steps or operations not presented and described herein may be used. Furthermore, not all illustrated steps or operations may be required to implement a technique in accordance with the disclosed subject matter.

The word "example" is used herein to mean serving as an example, instance, or illustration. Any aspect or design described herein as "example" is not necessarily to be construed as being preferred or advantageous over other aspects or designs. Rather, use of the word "example" is intended to present concepts in a concrete fashion. As used in this application, the term "or" is intended to mean an inclusive "or" rather than an exclusive "or." That is, unless specified otherwise or clearly indicated otherwise by the context, the statement "X includes A or B" is intended to mean any of the natural inclusive permutations thereof. That is, if X includes A; X includes B; or X includes both A and B, then "X includes A or B" is satisfied under any of the foregoing instances. In addition, the articles "a" and "an" as used in this application and the appended claims should generally be construed to mean "one or more," unless specified otherwise or clearly indicated by the context to be directed to a singular form. Moreover, use of the term "an implementation" or the term "one implementation" throughout this disclosure is not intended to mean the same implementation unless described as such.

Implementations of the computing device 600, and/or any of the components therein described with respect to FIG. 6 and/or any of the components therein described with respect to modules or components of FIG. 1, (and any techniques, algorithms, methods, instructions, etc., stored thereon and/or executed thereby) can be realized in hardware, software, or any combination thereof. The hardware can include, for example, computers, intellectual property (IP) cores, application-specific integrated circuits (ASICs), programmable logic arrays, optical processors, programmable logic controllers, microcode, microcontrollers, servers, microprocessors, digital signal processors, or any other suitable circuit. In the claims, the term "processor" should be understood as encompassing any of the foregoing hardware, either singly or in combination. The terms "signal" and "data" are used interchangeably.

Further, in one aspect, for example, the techniques described herein can be implemented using a general purpose computer or general purpose processor with a computer program that, when executed, carries out any of the respective methods, algorithms, and/or instructions described herein. In addition, or alternatively, for example, a special purpose computer/processor can be utilized which can contain other hardware for carrying out any of the methods, algorithms, or instructions described herein.

Further, all or a portion of implementations of this disclosure can take the form of a computer program product accessible from, for example, a computer-usable or computer-readable medium. A computer-usable or computer-readable medium can be any device that can, for example, tangibly contain, store, communicate, or transport the program for use by or in connection with any processor. The medium can be, for example, an electronic, magnetic, optical, electromagnetic, or semiconductor device. Other suitable mediums are also available.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method of converting a frame of a voice sample to a singing frame, comprising:

obtaining a pitch value of the frame by steps comprising:

calculating an autocorrelation of signals in a signal buffer;

identifying local maxima in the autocorrelation; and obtaining the pitch value using the local maxima;

obtaining formant information of the frame using the pitch value by steps comprising:

obtaining a window length using the pitch value;

calculating a power cepstrum of the frame using the window length; and obtaining the formant information from the power cepstrum;

obtaining aperiodicity information of the frame using the pitch value;

obtaining, from a reference sample, a tonic pitch;

using the formant information, the aperiodicity information, and the tonic pitch to obtain the singing frame from the frame of the voice sample, wherein obtaining the singing frame comprises:

determining, based on a phase shift between a sampling location and a preceding sampling location within the frame, to insert a respective pulse signal that approximates a human voice at the sampling location, wherein the respective pulse signal is a rapid and transient signal amplitude change; and outputting or saving the singing frame.

2. The method of claim 1, wherein obtaining the aperiodicity information of the frame using the pitch value comprises:

calculating a group delay using the pitch value; and calculating a respective aperiodicity value for each frequency sub-band of the frame.

3. The method of claim 1, wherein the tonic pitch is provided statically according to a preset pitch trajectory.

4. The method of claim 3, further comprising:

obtaining, from the reference sample, one or more chord pitches, wherein the one or more chord pitches comprise at least one chord pitch that is provided statically.

5. The method of claim 3, further comprising:

obtaining, from the reference sample, one or more chord pitches, wherein the one or more chord pitches comprise at least one chord pitch that is calculated using chord rules.

6. The method of claim 1, wherein the tonic pitch is calculated in real-time from the reference sample.

7. The method of claim 1, wherein using the formant information, the aperiodicity information, and the tonic pitch to obtain the singing frame comprises:

obtaining respective pulse signals for frequency sub-bands of the frame;

obtaining respective noise signals for the frequency sub-bands of the frame;

obtaining locations within the frame to insert the respective pulse signals and the respective noise signals;

obtaining an excitation signal; and obtaining the singing frame using the excitation signal.

8. An apparatus for converting a frame of a voice sample to a singing frame, comprising:

a processor, configured to:

obtain a pitch value of the frame;

obtain formant information of the frame using the pitch value, wherein the formant information is indicative of an identity of a speaker in the voice sample and is obtained based on spectrum smoothing;

obtain aperiodicity information of the frame using the pitch value;

obtain, from a reference sample, a tonic pitch and a chord pitch, wherein the tonic pitch and the chord pitch are obtained from music included in the reference sample, and where the tonic pitch and the chord pitch are applied to the voice sample;

use the formant information, the aperiodicity information, the tonic pitch and the chord pitch to obtain the singing frame, wherein the identity of the speaker is preserved in the singing frame, and wherein to obtain the singing frame comprises to:

determine whether to insert respective pulse signals at sampling locations of the frame, wherein the respective pulse signals are rapid and transient signal amplitude changes and approximate a human voice; and output or save the singing frame.

9. The apparatus of claim 8, wherein to obtain the pitch value of the frame comprises to:

calculate an autocorrelation of signals in a signal buffer;
identify local maxima in the autocorrelation; and
obtain the pitch value using the local maxima.

10. The apparatus of claim 8, wherein to obtain the formant information of the frame using the pitch value comprises to:
obtain a window length using the pitch value;
calculate a power cepstrum of the frame using the window length; and
obtain the formant information from the power cepstrum.

11. The apparatus of claim 8, wherein to obtain the aperiodicity information of the frame using the pitch value comprises to:
calculate a group delay using the pitch value; and
calculate a respective aperiodicity value for each frequency sub-band of the frame.

12. The apparatus of claim 8, wherein the tonic pitch is provided statically according to a preset pitch trajectory.

13. The apparatus of claim 12, wherein the chord pitch is provided statically.

14. The apparatus of claim 12, wherein the chord pitch is calculated using chord rules.

15. The apparatus of claim 8, wherein the tonic pitch and the chord pitch are calculated in real-time from the reference sample.

16. The apparatus of claim 8, wherein to use the formant information, the aperiodicity information, the tonic pitch and the chord pitch to obtain the singing frame comprises to:
obtain the respective pulse signals for frequency sub-bands of the frame;
obtain respective noise signals for the frequency sub-bands of the frame;
obtain locations within the frame to insert the respective pulse signals and the respective noise signals;
obtain an excitation signal; and
obtain the singing frame using the excitation signal.

17. A non-transitory computer-readable storage medium, comprising executable instructions that, when executed by a processor, facilitate performance of operations, comprising:
obtaining a pitch value of a frame of a voice sample;
obtaining formant information of the frame using the pitch value;
obtaining aperiodicity information of the frame using the pitch value;
obtaining, from a reference sample, a tonic pitch and a chord pitch;
using the formant information, the aperiodicity information, the tonic pitch, and the chord pitches to obtain a singing frame corresponding to the frame of the voice sample, wherein obtaining the singing frame comprises:
obtaining respective pulse signals for frequency sub-bands of the frame; wherein the respective pulse signals are rapid and transient signal amplitude changes;
obtaining respective noise signals for the frequency sub-bands of the frame;
obtaining locations within the frame to insert the respective pulse signals and the respective noise signals;
obtaining an excitation signal; and
obtaining the singing frame using the excitation signal; and
outputting or saving the singing frame.

18. The non-transitory computer-readable storage medium of claim 17,
wherein the tonic pitch is provided statically according to a preset pitch trajectory, and
wherein the chord pitch is provided statically or is calculated using chord rules.

* * * * *